US007504024B1

(12) United States Patent
Batten et al.

(10) Patent No.: US 7,504,024 B1
(45) Date of Patent: Mar. 17, 2009

(54) APPARATUS FOR DRAINING AT LEAST ONE SINK

(75) Inventors: William C. Batten, Asheboro, NC (US); Bruce W. Kyles, Asheboro, NC (US)

(73) Assignee: Thermaco, Inc., Asheboro, NC (US)

( * ) Notice: Subject to any disclaimer, the term of this patent is extended or adjusted under 35 U.S.C. 154(b) by 790 days.

(21) Appl. No.: 11/109,009

(22) Filed: Apr. 19, 2005

(51) Int. Cl.
*B01D 29/05* (2006.01)

(52) U.S. Cl. ..... 210/91; 210/154; 210/162; 210/236; 210/251; 210/470; 210/474; 4/286; 4/290; 4/291; 4/292

(58) Field of Classification Search ..... None
See application file for complete search history.

(56) References Cited

U.S. PATENT DOCUMENTS

| | | | | | |
|---|---|---|---|---|---|
| 220,064 | A | * | 9/1879 | Evans | 4/679 |
| 425,553 | A | * | 4/1890 | Smith | 285/20 |
| 480,692 | A | * | 8/1892 | Clifford et al. | 4/679 |
| 692,706 | A | | 2/1902 | Poate | 4/640 |
| 1,183,568 | A | | 5/1916 | Keevan | |
| 1,798,441 | A | * | 3/1931 | Weiss | 210/435 |
| 1,817,376 | A | * | 8/1931 | Izquierdo | 210/447 |
| 1,932,097 | A | * | 10/1933 | Biggs | 134/135 |
| 2,250,974 | A | | 7/1941 | Stoddard | 137/21 |
| 2,814,809 | A | * | 12/1957 | Boyle | 4/630 |
| 2,878,826 | A | | 3/1959 | Dolenga | 137/216 |
| 2,894,631 | A | * | 7/1959 | Levit et al. | 210/174 |
| 3,155,106 | A | * | 11/1964 | Baron | 137/216 |
| 3,455,324 | A | | 7/1969 | Bieri et al. | 137/216 |
| 3,495,280 | A | * | 2/1970 | Galbiati | 4/679 |
| 3,590,423 | A | * | 7/1971 | Messer | 452/194 |
| 3,742,093 | A | | 6/1973 | Skidmore | 260/893 |
| 3,872,017 | A | | 3/1975 | Bishop | 210/525 |
| 3,957,637 | A | | 5/1976 | Morey | 210/73 |
| 4,045,351 | A | * | 8/1977 | Peterson | 210/238 |
| 4,114,660 | A | * | 9/1978 | Arruda | 141/98 |
| 4,235,726 | A | | 11/1980 | Skimo | 210/523 |
| 4,268,396 | A | | 5/1981 | Lowe | 210/670 |
| 4,321,857 | A | * | 3/1982 | Best | 99/340 |
| 4,369,532 | A | * | 1/1983 | Houchins et al. | 4/619 |
| 4,480,656 | A | | 11/1984 | Johnson | 137/215 |
| 4,734,262 | A | | 3/1988 | Bagshawe | 422/101 |
| 5,016,667 | A | | 5/1991 | Tolf | 137/143 |

(Continued)

FOREIGN PATENT DOCUMENTS

| | | |
|---|---|---|
| EP | 555672 A1 | 8/1993 |

(Continued)

OTHER PUBLICATIONS

Information on IDEAL No-Hub Couplings; information from the internet; copyright 2000.

*Primary Examiner*—Robert James Popovics
(74) *Attorney, Agent, or Firm*—MacCord Mason PLLC

(57) ABSTRACT

An apparatus includes: a commercial kitchen sink having a drain; a trough below the sink for transporting effluent positioned such that there is an air gap between it and the drain; and a plurality of selectively positionable markers on the trough for indicating positions for strainers to collect solids in effluent discharging form the drain. A method of removing solids from an effluent flow from a kitchen sink having a drain hole is also disclosed.

15 Claims, 2 Drawing Sheets

U.S. PATENT DOCUMENTS 5,069,781 A * 12/1991 Wilkes ..... 210/164
5,091,095 A * 2/1992 Fries et al. ..... 210/742
5,098,564 A 3/1992 Miller et al. ..... 210/236
5,133,881 A 7/1992 Miller et al. ..... 210/776
5,159,958 A 11/1992 Sand ..... 137/888
5,178,754 A 1/1993 Batten et al. ..... 210/138
5,271,853 A 12/1993 Batten ..... 210/808
5,305,778 A 4/1994 Traylor ..... 137/216
5,360,555 A 11/1994 Batten ..... 210/803
5,397,464 A * 3/1995 Hannon ..... 210/163
5,405,538 A 4/1995 Batten ..... 210/744
5,452,739 A * 9/1995 Mustee et al. ..... 137/312
5,454,396 A 10/1995 Hochstrasser ..... 137/218
5,482,621 A 1/1996 Nurse ..... 210/170
5,486,287 A * 1/1996 Murphy et al. ..... 210/164
5,492,619 A 2/1996 Batten ..... 210/86
5,525,042 A 6/1996 Batten ..... 417/113
5,543,064 A 8/1996 Batten ..... 210/803
5,562,047 A * 10/1996 Forney et al. ..... 108/57.13
5,620,606 A 4/1997 McBrayer, Jr. et al. ..... 210/696
5,678,592 A 10/1997 Boticki et al. ..... 137/216
5,775,869 A * 7/1998 Bishop ..... 414/608
5,934,309 A * 8/1999 Batten ..... 137/216
5,948,279 A 9/1999 Change et al. ..... 210/808
5,951,878 A 9/1999 Astrom ..... 210/791
5,983,908 A * 11/1999 Bradley ..... 134/57 D
6,003,169 A * 12/1999 Davis, Jr. ..... 4/613
6,019,894 A 2/2000 Batten ..... 210/175
6,059,963 A 5/2000 Horakova et al. ..... 210/143
6,102,073 A * 8/2000 Williams ..... 137/602
6,116,266 A * 9/2000 Dickison et al. ..... 137/312
6,145,136 A * 11/2000 Parisi et al. ..... 4/291
6,173,856 B1 * 1/2001 Bierce et al. ..... 220/573
6,202,689 B1 * 3/2001 Williams ..... 137/602
6,213,002 B1 4/2001 Batten ..... 210/808
6,238,572 B1 5/2001 Batten ..... 210/739
6,261,462 B1 7/2001 Batten ..... 210/739
6,290,143 B1 * 9/2001 Vincent et al. ..... 238/2
6,328,901 B1 12/2001 Batten ..... 210/774
6,368,501 B1 4/2002 Batten ..... 210/181
6,413,435 B1 7/2002 Kyles et al. ..... 210/800
6,435,078 B1 8/2002 Batten et al. ..... 99/446
6,453,487 B1 * 9/2002 Babington ..... 4/619
6,453,488 B1 * 9/2002 Shamroth ..... 4/637
6,478,552 B1 11/2002 Batten et al. ..... 417/393
6,491,830 B1 12/2002 Batten et al. ..... 210/803
6,517,715 B1 2/2003 Batten et al. ..... 210/232
6,576,140 B1 6/2003 Batten ..... 210/744
6,582,205 B2 6/2003 Batten et al. ..... 417/393
6,601,248 B1 * 8/2003 Sage-Passant ..... 4/695
6,609,259 B2 * 8/2003 Cantrell ..... 4/688
6,629,652 B2 10/2003 Batten ..... 241/24.11
6,941,703 B2 * 9/2005 MacLean et al. ..... 52/34
6,994,221 B2 * 2/2006 Tse ..... 209/663
7,060,179 B1 * 6/2006 Batten et al. ..... 210/153
7,128,834 B2 * 10/2006 Davenport ..... 210/236
7,134,152 B1 * 11/2006 Batten et al. ..... 4/679
7,225,480 B2 * 6/2007 Mascheroni ..... 4/613
7,351,385 B1 * 4/2008 Batten et al. ..... 422/224
2002/0095720 A1 * 7/2002 Shamroth ..... 4/637
2003/0033670 A1 * 2/2003 Cantrell ..... 4/688

FOREIGN PATENT DOCUMENTS

GB 2216821 A 10/1989
SE 678438 9/1991

* cited by examiner

APPARATUS FOR DRAINING AT LEAST ONE SINK

BACKGROUND OF THE INVENTION (1) Field of the Invention

The present invention relates generally to commercial kitchen systems and, more particularly, to an apparatus for draining at least one sink. The apparatus includes a commercial kitchen sink having a drain; a trough below the sink for transporting effluent, the trough positioned such that there is an air gap between it and drain; a plurality of selectively positionable markers on the trough; and removable solids strainers configured to be positioned at a marker to locate the strainer below a drain.

(2) Description of the Prior Art

In order to maintain sanitary conditions, plumbing and health code regulations require device drains to be individually drained with a flow passing through a minimum air space to preclude potential cross-contamination caused by fluids migrating upstream due to a downstream blockage. Traditional air-gap connection methods have commonly used a pipe-and-cup arrangement. Effluent flows through a drain, passes through a mandated air-gap into a cup, and then passes through a pipe to a remote location. This conventional set-up requires an adequate vertical distance to be available. However, in many modern commercial kitchens, devices discharge low to the floor and preclude such a pipe-and-cup design, particularly if other equipment needs to be installed under the sink downstream of the drain.

A particular item of equipment that may need to be installed downstream of the drain is the Big Dipper® grease separator sold by Thermaco, Inc. of Asheboro, N.C. Grease separators remove oil and grease from kitchen sink effluent so that the remaining effluent is easier to process and clogging of pipes is reduced, in compliance with many sewage district codes. The oil/grease separators have tanks with quiescent zones to permit the oil and grease to float on top of the water and be susceptible to removal.

When using these and other grease separators, it may be desirable to remove solids from the effluent flow prior to flow into the separator. One method of removing solids includes placing a strainer in the effluent flow below the sink drain. However, to effectively remove solids from the flow, the strainer must be placed such that the effluent stream including the solids passes through the strainer. Therefore, an inexpensive device for eliminating activities such as determining where the strainer should be placed along a trough and monitoring the strainer to determine whether it is indeed aligned with effluent flow from an outlet of a sink drain may increase the operating efficiency of such kitchens. There remains, therefore, a need in the art for an apparatus for draining at least one kitchen sink that provides a trough below the sink for transporting effluent, the trough positioned such that there is an air gap between it and the drain; and a plurality of selectively positionable markers on the trough to guide strainer placement.

SUMMARY OF THE INVENTION

The present invention fulfills one or more of these needs by providing an apparatus for draining at least one sink having a downwardly disposed drain ending in a lower end. The apparatus includes a trough upwardly open to effluent flow discharging from the downwardly disposed drain. The trough extends beneath the sink and has a discharge end and an upstream end. Means are provided for positioning the trough to induce the effluent flow to the discharge end of the trough and to allow an air gap between the trough and the lower end of the drain. Selectively positionable markers mark a location of a sink drain above the apparatus to guide the positioning of a removable strainer. This enables the positioning of the strainer at the marker and consequent alignment of the strainer with the effluent flow from the drain to collect solids discharging from the drain into the apparatus.

In an embodiment of the invention, the apparatus includes a removable strainer for positioning in the trough at one of the markers. The apparatus may include a grease separator downstream of the trough. A sink is usually positioned having a downwardly disposed drain ending in a lower end. The strainer may include a handle. An indicator is preferably included to indicate a portion of the trough between two of the markers for positioning the strainer, to enable alignment of the strainer with the flow from the drain. The trough may be substantially U-shaped and include a series or apertures on a top flange for selectively positioning the markers. The trough has a depth, and the strainer preferably has a lesser depth to enable effluent to flow from upstream of the strainer, under the strainer, to downstream of the strainer. Each of the markers may include a pair of ears for guiding the positioning of the strainer, and a pair of lip portions, each having an aperture for coupling the marker to the trough.

In another aspect, the invention provides a method of installing an apparatus for removing solids from an effluent flow from a kitchen sink. The method includes fabricating a trough for placement below a drain hole of a kitchen sink, and positioning the trough below the drain hole. Further the method includes positioning the trough below the drain hole of the kitchen sink, selectively positioning drain hole markers along the trough; and inserting a strainer into the trough at one of the markers.

In yet another aspect the invention provides a method of removing solids from an effluent flow from a kitchen sink including discharging effluent flow containing solids from a drain hole of a sink. The method further includes collecting the solids from the effluent flow in a strainer positioned along a trough at a marker, removing the strainer from the trough, disposing of solids in the strainer; and replacing the strainer in the trough at the marker.

These and other aspects of the present invention will become apparent to those skilled in the art after a reading of the following description of the preferred embodiment when considered with the drawings.

DESCRIPTION OF THE PREFERRED EMBODIMENTS

The illustrations and description are for the purpose of describing an embodiment of the invention and do not limit the invention to any particular embodiment. Those of ordinary skill will recognize that the invention defined by the claims is capable of various and numerous embodiments.

Figure 1:
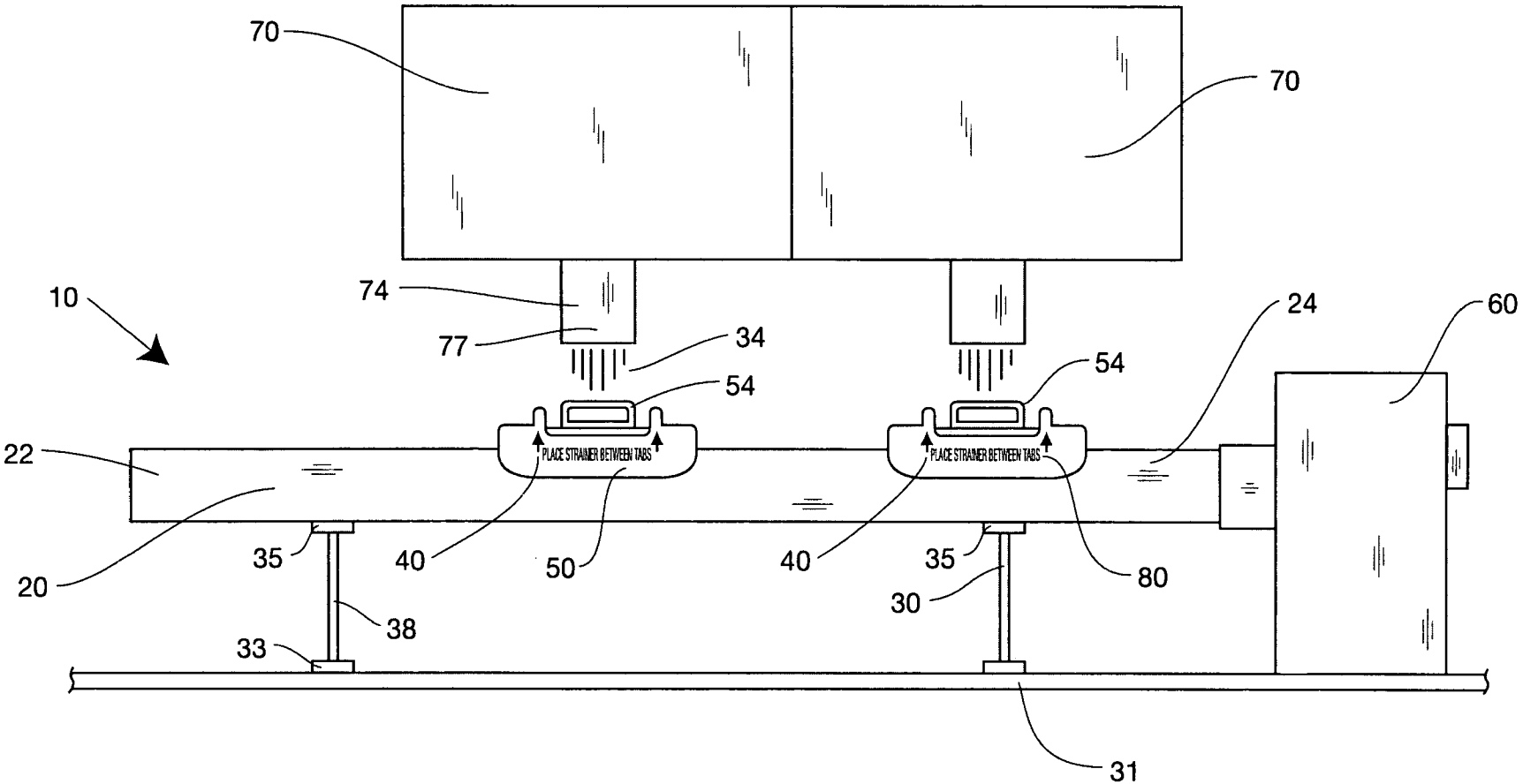
FIG. 1 is a side view of an embodiment of an apparatus for draining at least one sink and two sinks having downwardly disposed drains ending in a lower end.

FIG. 1 illustrates an apparatus 10 for draining at least one sink 70 that has a downwardly disposed drain 74 ending in a lower end 77. The apparatus 10 includes a trough 20 upwardly open to effluent flow discharging from the downwardly disposed drain 74. The trough 20 extends beneath the sink 70 and has a discharge end 24 and an upstream end 22. FIG. 1 shows the trough 20 extending under two sinks 70 with strainers 50 and positioning markers 40 provided in duplicate. The trough 20 can be fabricated of sheet metal, preferably stainless steel, of a variety of lengths, as needed for any given number of sinks, by duplication of the strainers 50 and markers 40.

The trough 20 includes a means 30 for positioning the trough 20 to induce the effluent flow to the discharge end 24 of the trough 20 and to provide an air gap 34 between the trough 20 and the lower end 77 of the drain 74. In one embodiment of the invention, the means 30 for positioning the trough 20 includes one or more standards 38 resting on a floor 31 or other surface below the trough 20 extending between the floor 31 surface and the trough 20 for supporting the trough 20. Fittings 35 on the bottom of the trough have holes with threads, and at least upper portions of the standards are threaded to permit height adjustments. Similar threaded adjustments can also be provided for the connection of the bottom of the standards to feet 33. The means for positioning the trough may be a support bracket made of a conventional hanger strap material. Other floor or wall-mounted straps can be the means for positioning or a component of the means for positioning the trough. Various combinations of nuts, bolts, screws, rods, straps, brackets, clamps, hangers, blocks, supports, feet, and other similar structures can be used to position the trough. In addition, a surface, such as the floor of a kitchen may provide the means. The apparatus may include a grease separator 60 downstream of the trough 20.

Figure 2:
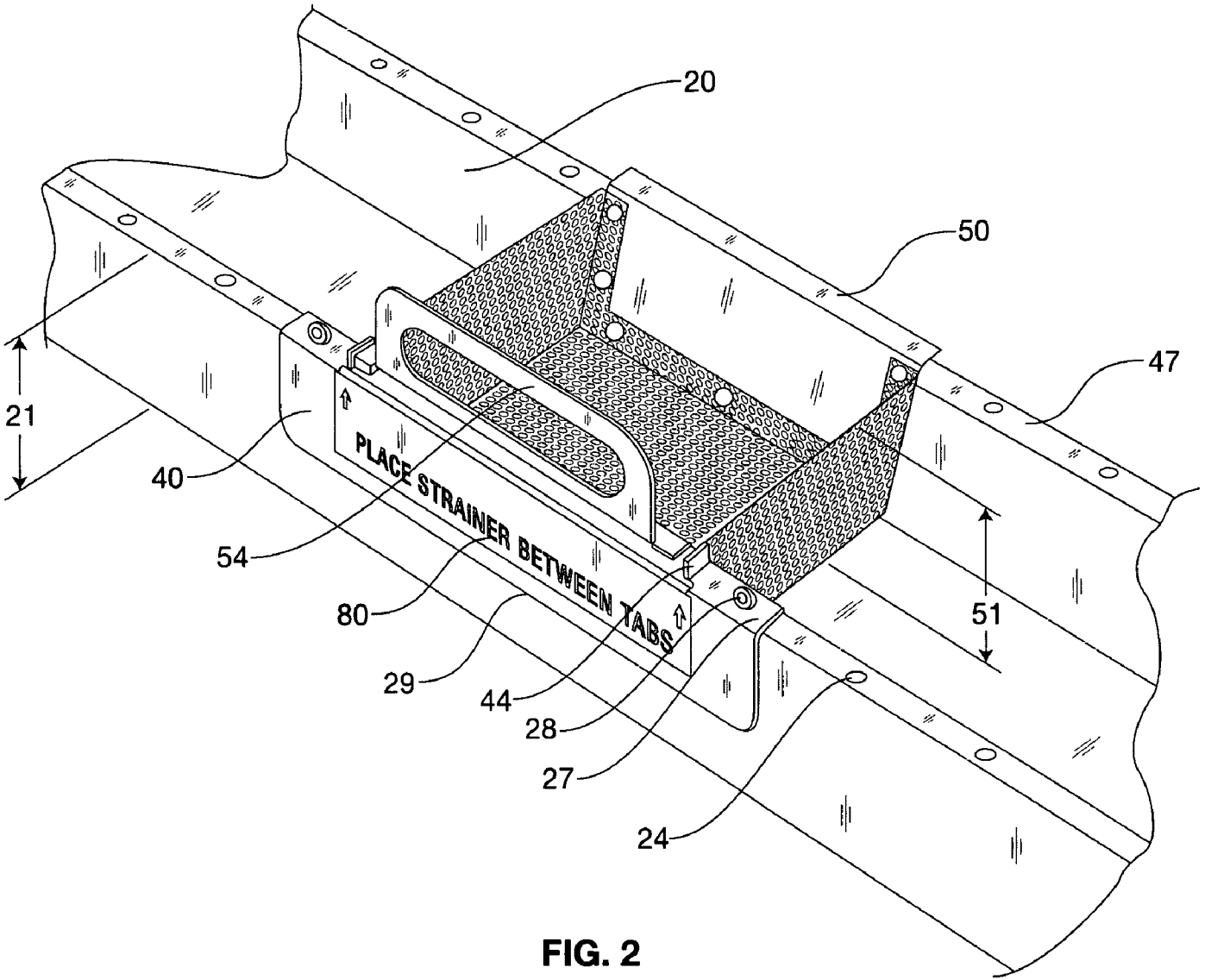
FIG. 2 is a top perspective view of an embodiment of a trough of an apparatus for draining at least one sink.

FIG. 2 is a top perspective view of the trough 20 including a selectively positionable marker 40 to mark a location of a sink drain above the apparatus for guiding the positioning of a removable strainer 50, thereby enabling the positioning of the strainer 50 at the marker 40 and consequent alignment of the strainer 50 with the effluent flow from the drain 74 to collect solids discharging from the drain. The strainer 50 may include a handle 54 for carrying the strainer 50 to a solid waste collection container (not shown) for disposal of solids from the strainer 50. The trough 20 may be substantially U-shaped with flanges 47 at its top. The upper flanges have holes 24 along the length of the flange 47. The series of holes 24 is provided in the flanges of the stock of the trough material so as the trough 20 is installed under the sink drain, the holes 24 that are under the sink drain can be selected for mounting the markers 40 to the trough 20. The trough 20 has a depth 21 and the strainer 50 has a depth 51 less than the depth 21 of the trough 20 to enable effluent to flow from upstream of the strainer, under the strainer, to downstream of the strainer.

The apparatus 10 may comprise written instructions 80, which may be located on a face 29 of a marker 40 and indicate a portion of the trough 20 where the strainer 50 should be placed to enable alignment of the strainer 50 with the flow from the drain 74. In an embodiment of the invention, each of the markers 40 includes a pair of lip portions 27 having at least one aperture 28 for coupling the marker to a hole 24 in the flange 47 of the trough. Each of the markers 40 has a pair of upwardly extending ears 44 spaced apart slightly more than the length of the strainer 50 so as to together define a position for the strainer 50, and to prevent longitudinal sliding of the strainer 50.

In operation of an embodiment of the invention, a method of removing solids from an effluent flow from a kitchen sink having a drain hole includes positioning a trough below the drain hole of the kitchen sink. The drain hole markers may be positioned along the trough to indicate the location of the drain hole. A strainer can be inserted into the trough at one of the markers. Thus, after an effluent flow containing solids is discharged for the sink through the drain hole, the strainer, and the trough, the strainer collects the solids from the effluent flow. The strainer can be removed from its position below the drain hole and its contents transferred to a solid waste collection container. The strainer can be replaced in the trough at the marker indicating the position of the drain hole, so that the process can continue.

Certain modifications and improvements will occur to those skilled in the art upon a reading of the foregoing description. Not every such modification and improvement is described herein, but is properly within the scope of the following claims.

We claim:

1. An apparatus for draining at least one sink that has a downwardly disposed drain ending in a lower end comprising:

a trough upwardly open to effluent flow discharging from the downwardly disposed drain, the trough configured to extend beneath the sink and having a discharge end and an upstream end;

a means for positioning the trough to induce the effluent flow to the discharge end of the trough and to provide an air gap between the bottom of the trough and the lower end of the drain; and a selectively positionable marker to mark a location of a sink drain above the trough for guiding the positioning of a removable strainer, thereby enabling the positioning of the strainer at the marker and consequent alignment of the strainer with the effluent flow from the drain to collect solids discharging from the drain into the apparatus.

2. The apparatus according to claim 1 further comprising a removable strainer for positioning in the trough at the marker.

3. The apparatus according to claim 1 further comprising a grease separator downstream of the trough.

4. The apparatus according to claim 1 further comprising a sink having a downwardly disposed drain ending in a lower end.

5. The apparatus according to claim 2 further comprising a handle coupled to the strainer.

6. The apparatus according to claim 2 wherein the trough has a depth and the strainer has a depth less than the depth of the trough to enable effluent to flow from upstream of the strainer, under the strainer, to downstream of the strainer.

7. The apparatus according to claim 1 further comprising instructions indicating a portion of the trough at the marker for positioning the strainer to enable alignment of the strainer with the flow from the drain.

8. The apparatus according to claim 1 wherein the trough comprises a series of apertures along a length of the trough for selectively positioning the marker.

9. The apparatus according to claim 8 wherein the marker comprises a lip portion having an aperture for coupling the marker to the trough.

10. The apparatus according to claim 9 wherein the lip portion comprises an upwardly extending ear such the ear defines a position for the strainer.

11. The apparatus according to claim 10 wherein the marker further includes a substantially planar face coupled to the lip portion and extending downwardly there from.

12. The apparatus according to claim 1 wherein the trough is substantially U-shaped with a flange at its top for coupling the marker to the trough.

13. An apparatus comprising:

a kitchen sink having a drain;

a trough below the sink for transporting effluent, the trough positioned such that there is an air gap between it and drain;

a selectively positionable marker on the trough; and a removable strainer at the selectively positionable marker.

14. A method of installing an apparatus for removing solids from an effluent flow from a kitchen sink comprising:

a. fabricating a trough for placement below a drain hole of a kitchen sink;

b. positioning the trough below the drain hole of the kitchen sink;

c. selectively positioning drain hole markers along the trough; and d. inserting a strainer into the trough at one of the markers.

15. An apparatus for draining at least one sink that has a downwardly disposed drain ending in a lower end comprising:

a substantially U-shaped trough having a flange at its top with a series of apertures in the flange, the trough having a depth, being upwardly open to effluent flow discharging from the downwardly disposed drain and configured to extend beneath the sink and having a discharge end and an upstream end;

means for positioning the trough to induce the effluent flow to the discharge end of the trough and to provide an air gap between the bottom of the trough and the lower end of the drain;

a selectively positionable marker including a lip portion configured for coupling the marker to the trough, a substantially planar face coupled to the lip portion and extending downwardly therefrom displaying instructions indicating a portion of the trough at the marker to enable alignment of a strainer with the flow from the drain, and an upwardly extending ear defining a strainer position; and a removable strainer having a handle and a depth less than the depth of the trough to enable effluent flow from upstream of the strainer, under the strainer, to downstream of the strainer, thereby enabling the positioning of the strainer at the marker adjacent the ear and consequent alignment of the strainer with the effluent flow from the drain to collect solids discharging from the drain into the apparatus.

* * * * *